US005941521A

United States Patent [19]

Enenkel et al.

[11] Patent Number: 5,941,521

[45] Date of Patent: Aug. 24, 1999

[54] DEVICE FOR RADIALLY DEFLECTING CONSIGNMENTS IN TRANSPORT PLANTS

[75] Inventors: Peter Enenkel, Constance; Bernd Bulle, Allensbach; Werner Frank, Reichenau, all of Germany

[73] Assignee: Licentia Patentverwaltungs-GmbH, Frankfurt, Germany

[21] Appl. No.: 08/765,573

[22] PCT Filed: Sep. 12, 1995

[86] PCT No.: PCT/EP95/03582

§ 371 Date: Apr. 23, 1997

§ 102(e) Date: Apr. 23, 1997

[87] PCT Pub. No.: WO96/33937

PCT Pub. Date: Oct. 31, 1996

[30] Foreign Application Priority Data

Apr. 27, 1995 [DE] Germany ..... 195 14 859

[51] Int. Cl.[6] ..... B65H 5/00

[52] U.S. Cl. ..... 271/225; 271/272

[58] Field of Search ..... 271/275, 272, 271/307, 188, 314, 225

[56] References Cited

U.S. PATENT DOCUMENTS 3,298,581 1/1967 Huck .
5,443,254 8/1995 Reist ..... 271/275 X
5,676,368 10/1997 Wilson et al. ..... 271/275 X

FOREIGN PATENT DOCUMENTS 2442788 6/1980 European Pat. Off. .
1177076 8/1964 Germany .
4345160 11/1994 Germany .
4437114 12/1995 Germany .
1567603 5/1980 United Kingdom .
2283731 5/1995 United Kingdom .

*Primary Examiner*—David H. Bollinger
*Attorney, Agent, or Firm*—Venable; George H. Spencer; Catherine M. Voorhees

[57] ABSTRACT

A device for radially deflecting consignments in transport plants permits consignments to be conveyed, in linear sections, clamped between an upper belt and a lower belt, where the upper belt urges the inner side of the curvature of the consignments to be conveyed against a surface profile of the deflection device. The deflection device on which the inner side of the curvature of the consignment rests has a surface profile with depressions on the side facing the consignment. The tangential length of the surface profile is at least as long as the outside of the respective consignment.

20 Claims, 5 Drawing Sheets

DEVICE FOR RADIALLY DEFLECTING CONSIGNMENTS IN TRANSPORT PLANTS

BACKGROUND OF THE INVENTION

The invention at hand concerns a device for radially deflecting consignments in transport plants where consignments are conveyed in linear path segments wedged between an upper and a lower belt.

In letter sorting plants, in particular in address readers, consignments up to a specific thickness of 9 mm, for example, are conveyed by means of an arrangement of cover belts, comprising a lower and an upper belt. Such a transport occurs in particular also in dynamic storage segments, where the consignments are stored mechanically following the address scanning until the reading result is supplied by the electronic reading equipment and a code corresponding to the reading result is printed onto the consignment.

A multiple deflection of the cover belt run is necessary, in particular in the storage segments to keep the space requirement low. For this, the cover belt is normally guided over large rollers, wherein the cover belt run is deflected by 180° or 90°. Such a plant is described in the DE 44 37 114.

In known plants, the consignments to be transported are transported standing between the upper and the lower belt, wherein the longest side of the consignment is positioned lengthwise to the transporting direction. The width of the belts is relatively narrow in relation to the maximum permissible height of the consignments to be transported (approximately 35 mm for plants with standard letter formats), so that additional guide rails are necessary to prevent a buckling of the consignments.

A further disadvantage of the narrow belts is the occurrence of carbon transfer, which damages carbon-copying papers that are transported in the consignments in such a way that the recipient cannot utilize the information transferred by the sender to the carbon-copying paper. For that reason, wider belts are used (approximately 90 mm) to be able to transport the consignments without additional guide rails and to prevent or limit carbon transfer.

With the presently known plants, a deformation in radial direction and thus a curvature on the curve inside of the consignment occurs at the deflection rollers as a result of the radial curvature of the respective consignment through the different radii of curvature for the inside and outside and the tangential shear restraint of the consignment inside by the outer edge of the letter.

When the consignment rolls off a deflection roller, this surface curvature is pressed directly against the roller or inner belt by the pressure from the outer belt, depending on the type of design. This leads to bending folds in the contact pressure area, caused by the outer belt. With a narrower belt width, these bending folds hardly interfere at all. With a wider belt width, already existing bending folds caused by preceding deflection rollers can cause the consignment to be torn up along the circulating consignment edge, thus resulting in intolerable damages. The amount of damage depends on the paper quality, the type of folding of the inserted consignments, the belt running speed, humidity etc. With wide belts, the bending folds continue to occur even in those ranges where the codes corresponding to the reading result have been printed on. As a result of this, the readability of the code can be limited or prevented.

SUMMARY OF THE INVENTION

It is therefore the object of the invention at hand to present a device with which the consignments can be deflected without bending folds, even with wide belts or rollers, without damaging the consignments or limiting the readability of the printed-on code. The solution according to the invention, is achieved by a device for radially deflecting consignments in transport plants where an upper belt presses the consignment to be conveyed with its curvature inside against the deflection device and the deflection device has as a surface profile with recesses on the side facing the consignment.

Advantageous embodiments of the invention follow from the dependent claims and the following description.

The device according to the invention is used on the curve inside. In this case, the surface of the device, which faces the consignment has a surface profile with recesses for accepting the curvatures of the consignments.

The device can be realized in that the surface profile is applied directly to a main roller or by surrounding the main roller and a possibly existing secondary roller with a belt having a surface profile with recesses on the outside. It is particularly advantageous for a protective treatment of the consignments if the surface profile has a wavelike shape and in this case the tangential length of the surface profile on which the respective consignment rests, is at least equal to the length of the outside of the respective consignment. This is achieved, for example, with a sinusoidal or circular arc surface design. This creates recesses for the curvatures, so that the curvatures are not bent or folded.

The longitudinal section of the surface profile can also be rectangular, triangular or have a saw-tooth shape. It is also possible to provide webs that are positioned perpendicular or diagonal to the transporting direction, between which the recesses are located. Finally, a surface profile can be used where bumps with a longitudinal cross section with semicircles to three-quarter circles are applied with a certain spacing to a level surface, between which the recesses are located. The above listing is not complete. Any conceivable surface profile with recesses that run lateral or diagonal to the transporting direction can be selected, wherein wave-shaped surface profiles treat the consignments particularly gently.

The surface profile can be formed perpendicular to the belt movement direction or also in the range between 45° and 90° to the belt movement direction. Angles between 70° and 75° have proven to be particularly advantageous. The waves can have a sinusoidal or circular arc profile. However, camel hump-shaped waves are also possible. These are realized in that the height of a sinus or circular arc profile is provided with a circular arc or sinusoidal groove with less depth than the height for the sinus or circular arc profile.

Furthermore, the wavelike shape of the surface must be realized by arranging nubs with the height necessary for the wavelike shape at a short distance to each other. Finally, it can be advantageous to provide the wavelike surface profiles with slots or grooves.

A so-called herringbone pattern proves to be particularly advantageous: In this case, two wave-shaped profiles with a specific angle run counter to each other, wherein a groove exists between the wave-shaped profiles for accepting the folds of the consignments, which come together in this range.

BRIEF DESCRIPTION OF THE DRAWINGS

The invention is explained in more detail in the following description with the aid of the figures for the various in which.

FIG. 1 is a portion of the deflection device according to the invention, an upper belt and a consignment located in-between;

DETAILED DESCRIPTION OF THE INVENTION

Figure 1:
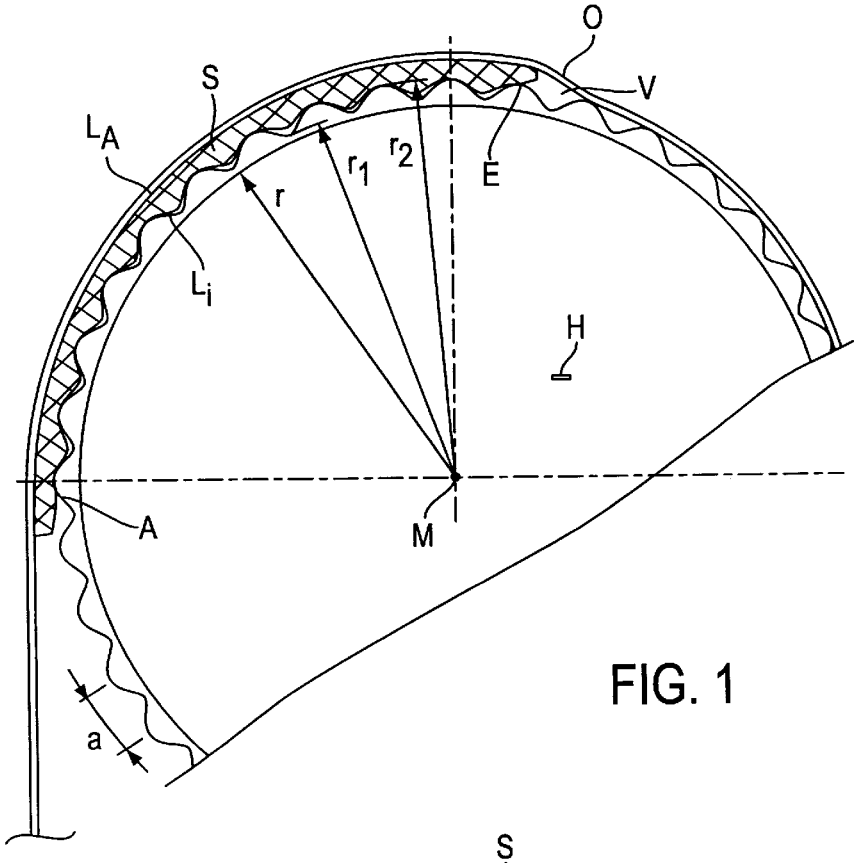

FIG. 1 shows the consignment S, which is pressed by the upper belt O against the inventive deflection device, which in this case is a main roller H with wave-shaped surface profile P. The profile has a circular arc shape and has recesses V with the height h and the distance a from wave peak to wave peak. The height h is understood to be the difference between radii $r_2$ and $r_1$, wherein $r_2$ represents the distance of the wave peaks from the mid-point M of main roller H and $r_1$ the distance of the wave troughs to the mid-point M of the main roller. In order to ensure that the recesses V for accepting the curvatures of the consignments S are sufficient, the tangential roll-off area $L_i$ of the wave-shaped profile P, on which the consignment S rests between the points A and E, must be at least as big as the outside length $L_A$ of the consignment. This condition is given, for example, with a roller radius r=140 mm, a maximum consignment thickness of 7 mm and a wave distance a=20 mm for a minimum height h=3.1 mm. It is possible, for example, to determine the wave distance a empirically in that the distances between surface curvatures on a consignment with maximum dimensions (length, width, thickness) are measured. The surface curvatures are produced by a bending of the consignment with the radius r of the main roller H.

These distances then provide the approximate value for a. The exact value for a is obtained in that a must be a whole number multiple of the circumference of the main roller H or the length of the elastic belt EB, so that the continuous wave shape of the wave-shaped surface profile P is provided.

With the aforementioned dimensions, a recess V with the height h=4 mm is particularly advantageous. However, it is also possible to use larger recesses.

The disadvantage of using even larger recesses is the increased material use, an increased noise level during the operation and the deteriorating operating characteristics for elastic belts with wave-shaped profile over the secondary rollers. As a result of the wave-shaped design of the surface, the surface curvatures can occur on the inside of consignment S, without folding or bending the consignment. The consignment S thus remains undamaged.

Figure 2:
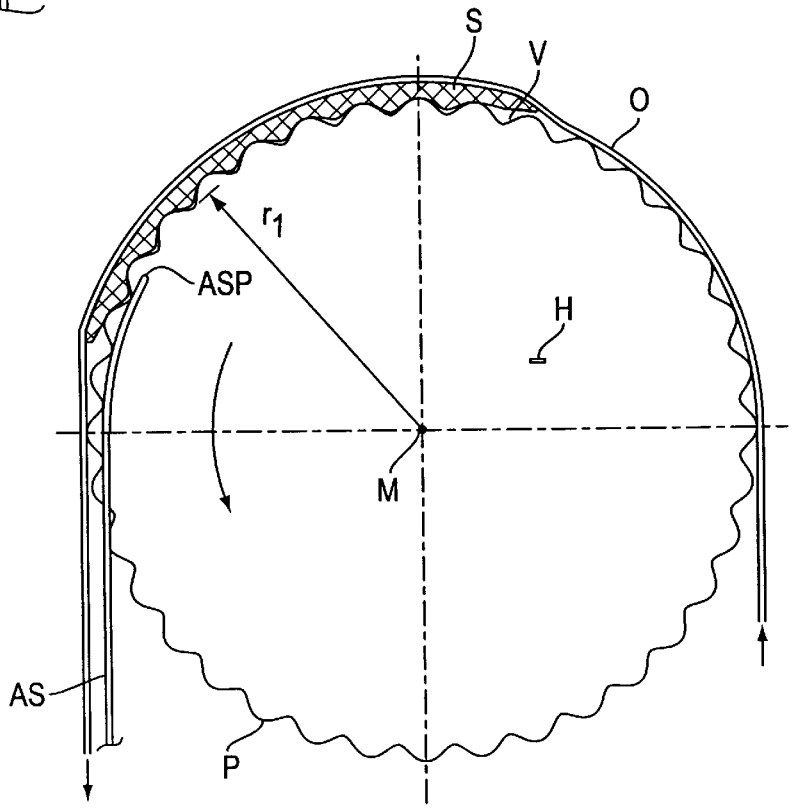
FIG. 2 is a main roller with wave-shaped surface profile.

In FIG. 2, the surface profile P is applied directly to the main roller H. This can be realized in that the roller H and the surface profile are produced in one piece from the same material. However, it is also possible to produce the main roller H cylindrically and to apply the surface profile P, made from another material such as rubber, Vulkolan or a high-resistance foam. It is also possible to pull a rubber ring provided with the surface profile P over a cylindrical main roller.

The main roller H advantageously has a radially circulating groove in the center of its height, which divides the surface profile and for which the radius is smaller than the radius $r_1$ between the wave troughs and the mid-point for main roller H. It is advantageous if a stripping device AS engages into this groove in such a way that at the stripping point ASP its surface facing the consignment is below the recesses located at the stripping point ASP. This stripping device removes the consignment from the main roller H and forces it onto a linear path. The stripping device can, for example, consist of a sheet metal piece.

Figure 3:
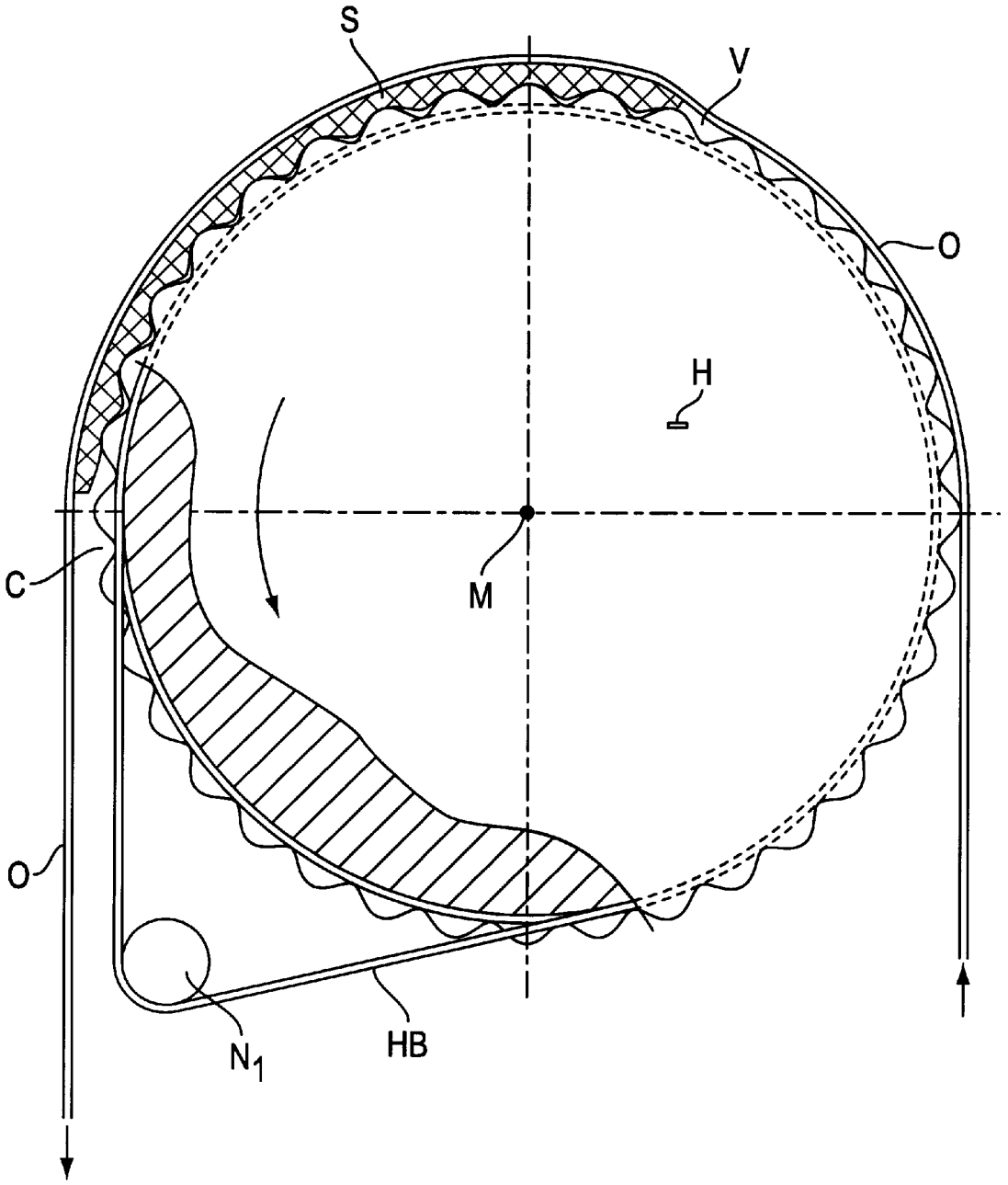
FIG. 3 is a main roller with ring-shaped surface profile, a narrow belt and a secondary roller.

A different stripping device is shown in FIG. 3. In this case as in FIG. 2, the main roller itself has a radially circulating groove, wherein for the example at hand, the groove is provided for accepting the auxiliary belt HB. The auxiliary belt HB is additionally guided around the secondary roller $N_1$.

The groove itself is made deep enough so that the auxiliary belt HB does not cause any bends at the consignment S surface curvatures. The main roller H rotates in the indicated arrow direction.

As soon as the consignment S reaches the area C, the jointly circulating auxiliary belt HB pushes the consignment S away from the surface profile and into a linear movement direction between the auxiliary belt HB and the upper belt O.

Figure 4:
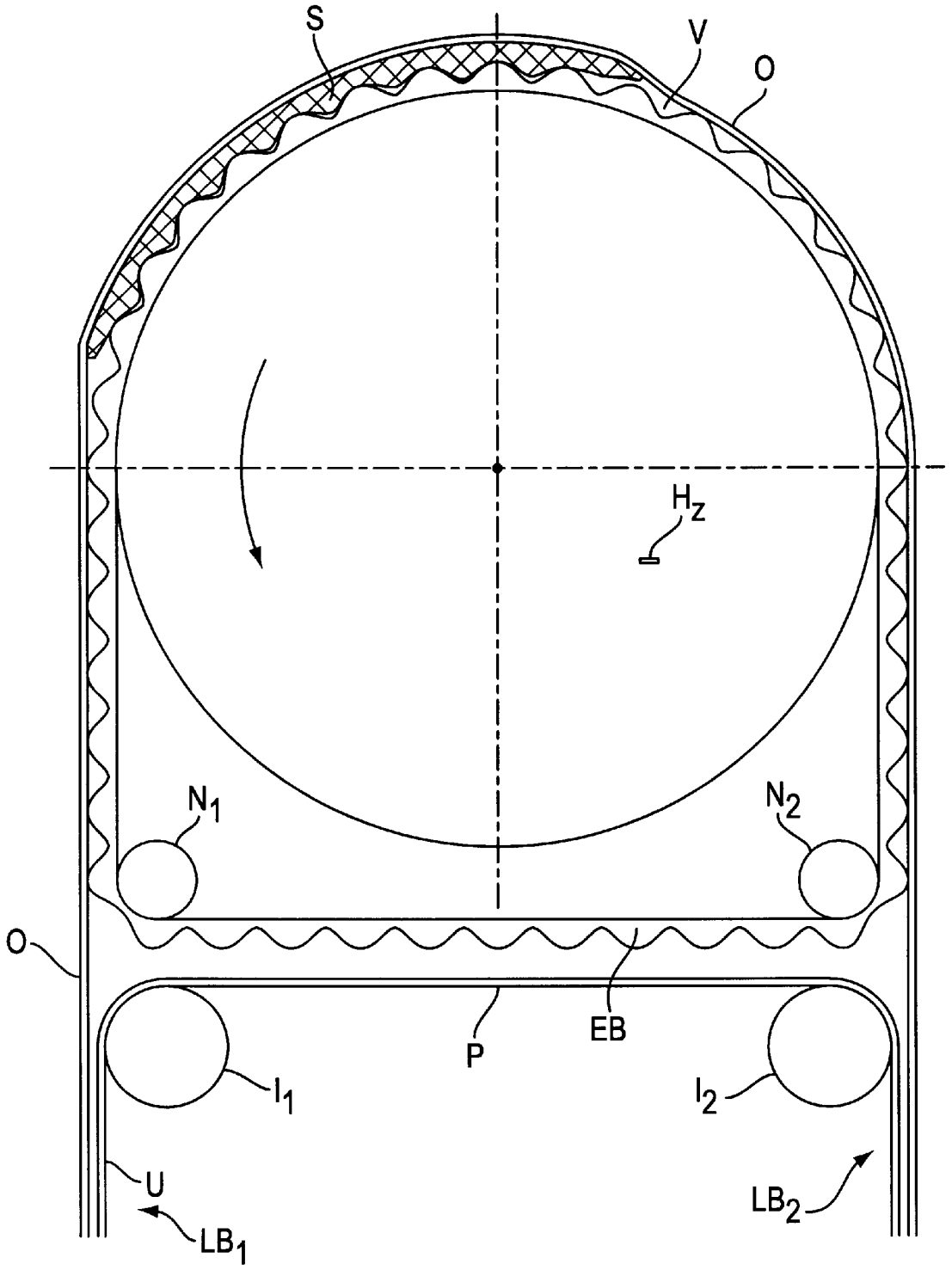
FIG. 4 is a main roller and two secondary rollers over which an elastic belt with wave-shaped surface profile is guided, as well as an upper belt, a consignment to be transported and a lower belt.

The inventive device shown in FIG. 4 comprises the cylindrical roller Hz and two secondary rollers $N_1$ and $N_2$ across which the elastic belt EB with surface profile P is stretched. Here too, the consignment S is pressed by the upper belt O against the surface profile P, without bending of the surface curvatures. By guiding the elastic belt EB with surface profile P over the secondary roller $N_1$, the consignment S is moved gently from the radial movement direction to the linear movement direction and, after passing the secondary roller $N_1$, is later on gripped by the lower belt U and wedged between the upper belt O and the lower belt U where it is transported further in linear direction in the linear range $LB_1$. The guiding of the elastic belt EB around the secondary roller $N_2$ and the guiding of the lower belt U around the roller $I_2$ improves the guidance during the intake of the consignment S from the linear range $LB_2$ into the inventive deflection device.

Figure 5:
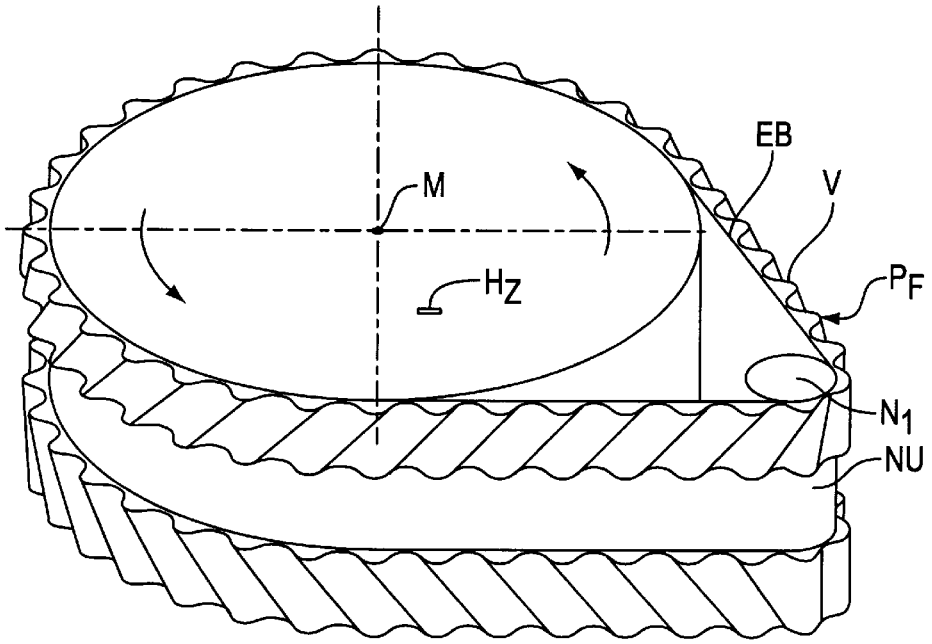
FIG. 5 is a perspective view of a main roller and a secondary roller over which an elastic belt with herringbone pattern and groove in-between is guided.

FIG. 5 shows a view of an inventive device, comprising one main roller $H_2$ and a secondary roller $N_1$, around which an elastic belt EB is guided. The special feature of this elastic belt EB is the shape of the wave-shaped surface profile $P_F$. It consists of two mutually displaced, wave-shaped profiles, which respectively occupy an angle of approximately 70° to the movement direction and which are separated by a groove NU that runs in the movement direction through the center of the elastic belt EB.

The slanted position of the profiles results in a quieter run of the elastic belt EB, in particular around the secondary roller $N_1$. The groove NU is provided to accept the surface curvatures, which develop on the consignment inside and run in opposite directions.

Figure 6:
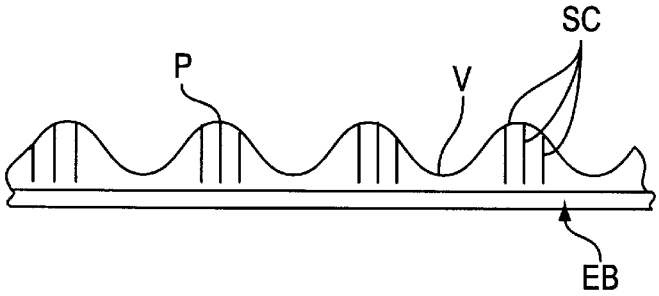
FIG. 6 is a section of a slotted, wave-shaped belt.
Figure 7:
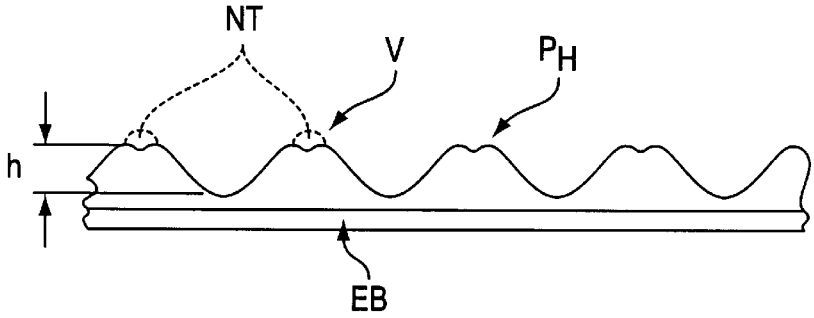
FIG. 7 is a section of a belt with wavelike camel hump design.

FIG. 6 shows a partial section of an elastic belt with slots SC in the wave-shaped profile P, which slots are arranged lateral to the propagation direction for the waves of the wave-shaped surface profile P. The noise developing during the operation can be reduced with this as well. FIG. 7 finally shows a profile $P_H$ where a circular arc or sinusoidal groove NT with a depth lower than the height h of the circular arc or sinusoidal profile has been worked into the height of a profile with circular arc or sinusoidal shape.

Figure 8:
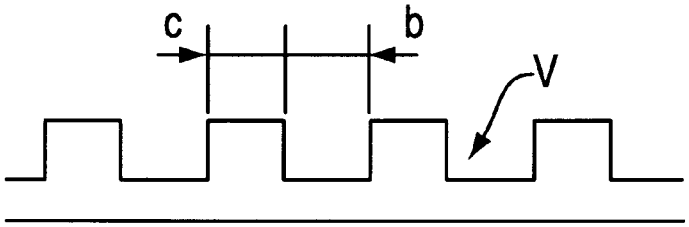
FIG. 8 is a section of a belt with a rectangular surface profile.

FIG. 8 shows a partial segment of an elastic belt with a rectangular surface profile. The length b of the recess V can be longer than the length c of the raised portion. The sum of the lengths b+c is approximately equal to the wave distance a.

Figure 9:
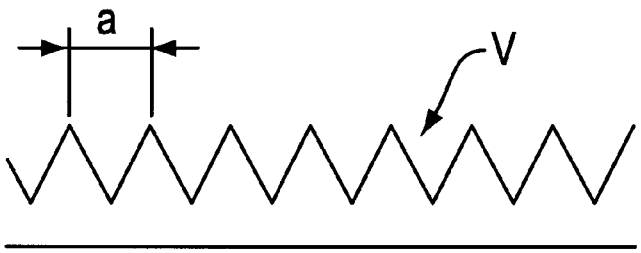
FIG. 9 is a section of a belt with a triangular surface profile.

FIG. 9 shows a partial section of an elastic belt with a triangular surface profile. The distance between neighboring triangle points corresponds advantageously to the wave distance a.

Figure 10:
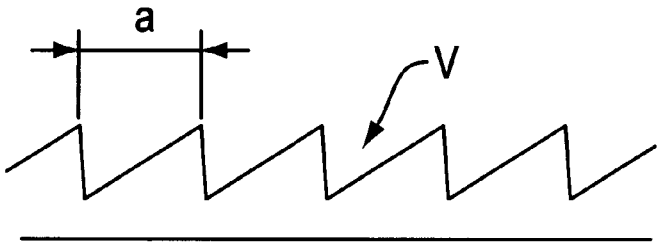
FIG. 10 is a section of a belt with a saw-tooth shaped surface profile.

FIG. 10 shows a partial section of an elastic belt with a saw-tooth shaped surface profile. Here too, the distance between neighboring saw-tooth peaks is advantageously that of the wave distance a.

Figure 11:
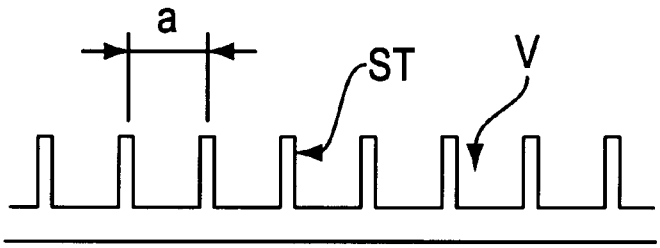
FIG. 11 is a section of a belt with fitted on webs.

It is advantageous if the distance of the web ST shown in FIG. 11 to the respectively next web ST also corresponds to the wave distance a.

Figure 12:
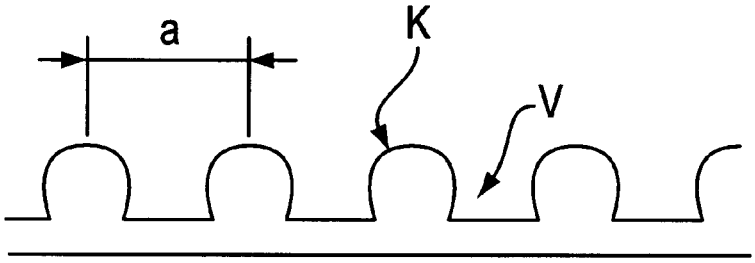
FIG. 12 is a section of a belt with fitted on three-quarter circles.

FIG. 12 finally shows another option for designing the surface profile with bumps K in the shape of three-quarter circles, between which the recesses V are located.

We claim:

1. A device for the radial deflection of consignments in transport plants, the consignments being conveyed in linear path segments wedged between an upper and a lower belt in a transporting direction, said radial deflection device comprising a surface profile with recesses and wherein the upper belt presses an inside curvature of consignments to be conveyed against the surface profile of the radial deflection device.

2. A device according to claim 1, wherein the surface profile has a rectangular shape.

3. A device according to claim 1, wherein the surface profile has a saw-tooth design.

4. A device according to claim 1, wherein the surface profile has a triangular design.

5. A device according to claim 1, wherein the surface profile has webs.

6. A device according to claim 1, wherein the surface profile has bumps in the shape of a three-quarter circle.

7. A device according to claim 1, wherein the surface profile has slots.

8. A device according to claim 1, wherein the surface profile has a wave-shaped design.

9. A device according to claim 8 characterized in that the wave-shaped surface profile (P) has a sinusoidal design.

10. A device according to claim 8, wherein the wave-shaped surface profile (P) has a circular arc design.

11. A device according to claim 8, wherein the wave-shaped surface profile is arranged perpendicular to the transporting direction of the consignment.

12. A device according to claim 9, wherein the wave-shaped surface profile is diagonal to the transporting direction.

13. A device according to claim 8, wherein the wave-shaped surface profile is at an angle of more than 45° and less than 90° to the transporting direction.

14. A device according to claim 8, wherein the surface profile is constructed from a foam material.

15. A device according to claim 8, wherein the wave-shaped surface profile has a tangential length on which the inside curvature of a respective consignment rests, said tangential length being at least equal to the outside length of the respective consignment which faces the upper belt.

16. A device according to claim 1, further comprising a main roller having a mid-point and an outside surface and wherein the surface profile is wave-shaped and the outside surface of the main roller is formed with the wave-shaped surface profile.

17. A device according to claim 16, wherein the main roller has a radially, circulating groove formed in the outside surface, the outside surface being of a height and the groove being formed in the center of the height of the outside surface, the groove having a radius that is smaller than a radius extending between a wave trough of the surface profile and the mid-point of the main roller.

18. A device according to claim 17, further comprising a stripping device which engages the groove for removing the consignment from the main roller and forcing the consignment onto a linear path.

19. A device according to claim 17, further comprising an auxiliary belt and a secondary roller wherein the auxiliary belt is guided in the radially circulating groove and over at least one secondary roller.

20. A device according to claim 1, further comprising a main roller, at least one secondary roller, all of the rollers having a cylindrical design, and an elastic belt which is guided around the main roller and the at least one secondary roller wherein the elastic belt has the surface profile which is wave-shaped and formed on the side of the belt which faces away from the main roller and the at least one secondary roller.

* * * * *